US009583235B2

(12) United States Patent
Nonen et al.

(10) Patent No.: US 9,583,235 B2
(45) Date of Patent: Feb. 28, 2017

(54) MULTIPAIR DIFFERENTIAL SIGNAL TRANSMISSION CABLE

(71) Applicant: Hitachi Cable, Ltd., Tokyo (JP)

(72) Inventors: Hideki Nonen, Hitachi (JP); Takahiro Sugiyama, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 252 days.

(21) Appl. No.: 13/785,831

(22) Filed: Mar. 5, 2013

(65) Prior Publication Data

US 2013/0333913 A1 Dec. 19, 2013

(30) Foreign Application Priority Data

Jun. 19, 2012 (JP) ..... 2012-138037

(51) Int. Cl.
*H01B 11/08* (2006.01)
*H01B 11/18* (2006.01)
*H01B 11/20* (2006.01)

(52) U.S. Cl.
CPC ..... *H01B 11/085* (2013.01); *H01B 11/1826* (2013.01); *H01B 11/20* (2013.01)

(58) Field of Classification Search
CPC ..... H01B 11/085; H01B 11/08; H01B 11/20; H01B 11/18; H01B 11/26; H01B 13/262;
(Continued)

(56) References Cited

U.S. PATENT DOCUMENTS 5,502,287 A * 3/1996 Nguyen ..... 174/113 R
5,574,250 A * 11/1996 Hardie et al. ..... 174/36
(Continued)

FOREIGN PATENT DOCUMENTS

CN 102201276 A 9/2011
JP 49-016881 A 2/1974
(Continued)

OTHER PUBLICATIONS

Japanese Office Action dated Oct. 14, 2014 with English Translation.

(Continued)

*Primary Examiner* — Courtney Smith
*Assistant Examiner* — Christopher L Augustin
(74) *Attorney, Agent, or Firm* — McGinn IP Law Group, PLLC

(57) ABSTRACT

A multipair differential signal transmission cable includes a plurality of differential signal transmission cables being bundled and each including two signal conductors as a differential pair covered with an insulation and a first shielding tape conductor provided therearound. The first shielding tape conductor is longitudinally lapped so as to have an overlapping portion in a cable longitudinal direction. The plurality of differential signal transmission cables include at least one or more pairs of two adjacent differential signal transmission cables. The two adjacent differential signal transmission cables are arranged such that the overlapping portion of one of the two adjacent differential signal transmission cables does not face the other of the two adjacent differential signal transmission cables.

20 Claims, 7 Drawing Sheets

(58) Field of Classification Search
CPC ..... H01B 13/26213; H01B 11/1826; H01B 11/105
USPC ..... 174/34, 102 R, 105 R, 113 R, 117 F, 116
See application file for complete search history.

(56) References Cited

U.S. PATENT DOCUMENTS

| | | | | |
|---|---|---|---|---|
| 6,010,788 | A * | 1/2000 | Kebabjian et al. | 428/381 |
| 6,259,019 | B1 * | 7/2001 | Damilo et al. | 174/36 |
| 6,293,081 | B1 * | 9/2001 | Grulick | G02B 6/449 174/112 |
| 7,790,981 | B2 * | 9/2010 | Vaupotic | H01B 11/1008 174/113 R |
| 8,039,749 | B2 * | 10/2011 | Okano et al. | 174/113 R |
| 8,378,217 | B2 | 2/2013 | Sugiyama et al. | |
| 8,440,910 | B2 * | 5/2013 | Nonen et al. | 174/115 |
| 8,575,488 | B2 * | 11/2013 | Sugiyama et al. | 174/105 R |
| 8,674,228 | B2 * | 3/2014 | Dion et al. | 174/105 R |
| 2003/0047347 | A1 * | 3/2003 | Lin et al. | 174/113 R |
| 2004/0026101 | A1 * | 2/2004 | Ochi | 174/36 |
| 2009/0260847 | A1 * | 10/2009 | Tobben et al. | 174/107 |
| 2010/0065299 | A1 * | 3/2010 | Liu | H02G 15/025 174/102 R |
| 2010/0307785 | A1 * | 12/2010 | Kolasa et al. | 174/36 |
| 2011/0139485 | A1 * | 6/2011 | Matsuda et al. | 174/102 R |
| 2011/0232941 | A1 | 9/2011 | Sugiyama et al. | |
| 2012/0186850 | A1 * | 7/2012 | Sugiyama et al. | 174/102 R |
| 2013/0248221 | A1 * | 9/2013 | Booth et al. | 174/103 |
| 2014/0209343 | A1 * | 7/2014 | Gundel | H01B 7/0861 174/34 |

FOREIGN PATENT DOCUMENTS

| | | | |
|---|---|---|---|
| JP | 2002-289047 | A | 10/2002 |
| JP | 2002-304921 | A | 10/2002 |
| JP | 2004-87189 | A | 3/2004 |

OTHER PUBLICATIONS

Chinese Office Action dated Mar. 29, 2016 with an English translation.

* cited by examiner

MULTIPAIR DIFFERENTIAL SIGNAL TRANSMISSION CABLE

The present application is based on Japanese patent application No. 2012-138037 filed on Jun. 19, 2012, the entire contents of which are incorporated herein by reference.

BACKGROUND OF THE INVENTION

1. Field of the Invention

The invention relates to a multipair differential signal transmission cable.

2. Description of the Related Art

A multipair differential signal transmission cable is known that is formed by bundling plural differential signal transmission cables (see, e.g., JP-A-2004-087189).

JP-A-2004-087189 (FIGS. 2 and 6) discloses an assembled transmission cable (a multipair differential signal transmission cable) formed by assembling plural transmission cables (differential signal transmission cables) each having a signal line pair as a pair of insulated wires each composed of a signal line covered with an insulation layer, a drain wire, a shield material covering the pair of signal lines as well as the drain wire and a cushioning material covering an outer periphery of the shield material.

SUMMARY OF THE INVENTION

The multipair differential signal transmission cable disclosed in JP-A-2004-087189 has a problem that quality of signal deteriorates due to pair-to-pair crosstalk.

The pair-to-pair crosstalk is caused by transmission of electromagnetic energy from a differential signal transmission cable not contributing to signal transmission (hereinafter, referred to as "Agressor") to a differential signal transmission cable contributing to signal transmission (hereinafter, referred to as "Victim"). The transmission of electromagnetic energy is induced mainly by a common-mode component of which electric field spreads widely.

In addition, in a typical multipair differential signal transmission cable, a spread of common-mode electric field (leakage of common-mode energy) is prevented by shielding each pair using a shielding tape conductor but, in effect, a magnetic field is generated by a current (a common-mode current) flowing though the shielding tape conductor and a common-mode component generated thereby causes the pair-to-pair crosstalk. An energy amount of the common-mode component at this time depends on the current (the common-mode current) flowing through an outer surface of the shielding tape conductor.

As described above, the causes of pair-to-pair crosstalk include the transmission of common-mode energy between the pairs and the common-mode current in each pair.

Accordingly, it is an object of the invention to provide a multipair differential signal transmission cable with low pair-to-pair crosstalk.

(1) According to one embodiment of the invention, a multipair differential signal transmission cable comprises:

a plurality of differential signal transmission cables being bundled and each comprising two signal conductors as a differential pair covered with an insulation and a first shielding tape conductor provided therearound, wherein the first shielding tape conductor is longitudinally lapped so as to have an overlapping portion in a cable longitudinal direction, wherein the plurality of differential signal transmission cables comprise at least one or more pairs of two adjacent differential signal transmission cables, and wherein the two adjacent differential signal transmission cables are arranged such that the overlapping portion of one of the two adjacent differential signal transmission cables does not face the other of the two adjacent differential signal transmission cables.

In the above embodiment (1) of the invention, the following modifications and changes can be made.

(i) The differential signal transmission cables are arranged so that the overlapping portion of at least one of the plurality of differential signal transmission cables faces an outside of the multipair differential signal transmission cable (i.e., without facing an inside of the multipair differential signal transmission cable).

(ii) The differential signal transmission cables are arranged so that the overlapping portion of all of the plurality of adjacent differential signal transmission cables faces an outside of the multipair differential signal transmission cable (i.e., without facing an inside of the multipair differential signal transmission cable).

(iii) The first shielding tape conductor is longitudinally lapped so that the overlapping portion is located on a perpendicular line passing through substantially the middle of a line connecting the two signal conductors.

(iv) The differential signal transmission cable does not include a drain wire, and wherein the two signal conductors are covered all together with the insulation having a shape that does not create a gap from the first shielding tape conductor.

(v) The two signal conductors are covered all together with the insulation having a flat oval cross-sectional shape that comprises flat portions parallel to an arrangement direction of the two signal conductors.

(vi) The two signal conductors are covered all together with the insulation having an ellipse cross-sectional shape that is long in an arrangement direction of the two signal conductors.

(vii) Two of the differential signal transmission cables are arranged in the middle of the multipair differential signal transmission cable as viewed in a cross section, and wherein six of the differential signal transmission cables are arranged therearound via an inclusion.

(viii) An inclusion is arranged in the middle of the multipair differential signal transmission cable as viewed in a cross section, and wherein eight of the differential signal transmission cables are arranged around the inclusion.

(ix) The multipair differential signal transmission cable further comprises:

a second shielding tape conductor wrapping the plurality of differential signal transmission cables all together;

a braided wire covering a periphery of the second shielding tape conductor; and a jacket covering the braided wire.

(x) The plurality of differential signal transmission cables comprise at least one or more pairs of two adjacent differential signal transmission cables disposed in a circumferential direction of the multipair differential signal transmission cable, and wherein the two adjacent differential signal transmission cables are arranged such that the overlapping portion of one of the two adjacent differential signal transmission cables does not face the other of the two adjacent differential signal transmission cables.

Points of the Invention

According to one embodiment of the invention, a multipair differential signal transmission cable is constructed such that the overlapping portion is arranged so as not to face the adjacent differential signal transmission cable. The differential signal transmission cables are twisted such that the overlapping portion preferably faces the outside of the multipair differential signal transmission cable (i.e., without facing the inside thereof). As a result, the common-mode electric field can spread toward the outside of the multipair differential signal transmission cable, and the level of electromagnetic interference (i.e., crosstalk) to the adjacent cable, especially the cable located in the middle of the cable, can be significantly reduced.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

First Embodiment of the Invention

Structure of Multipair Differential Signal Transmission

Figure 1:
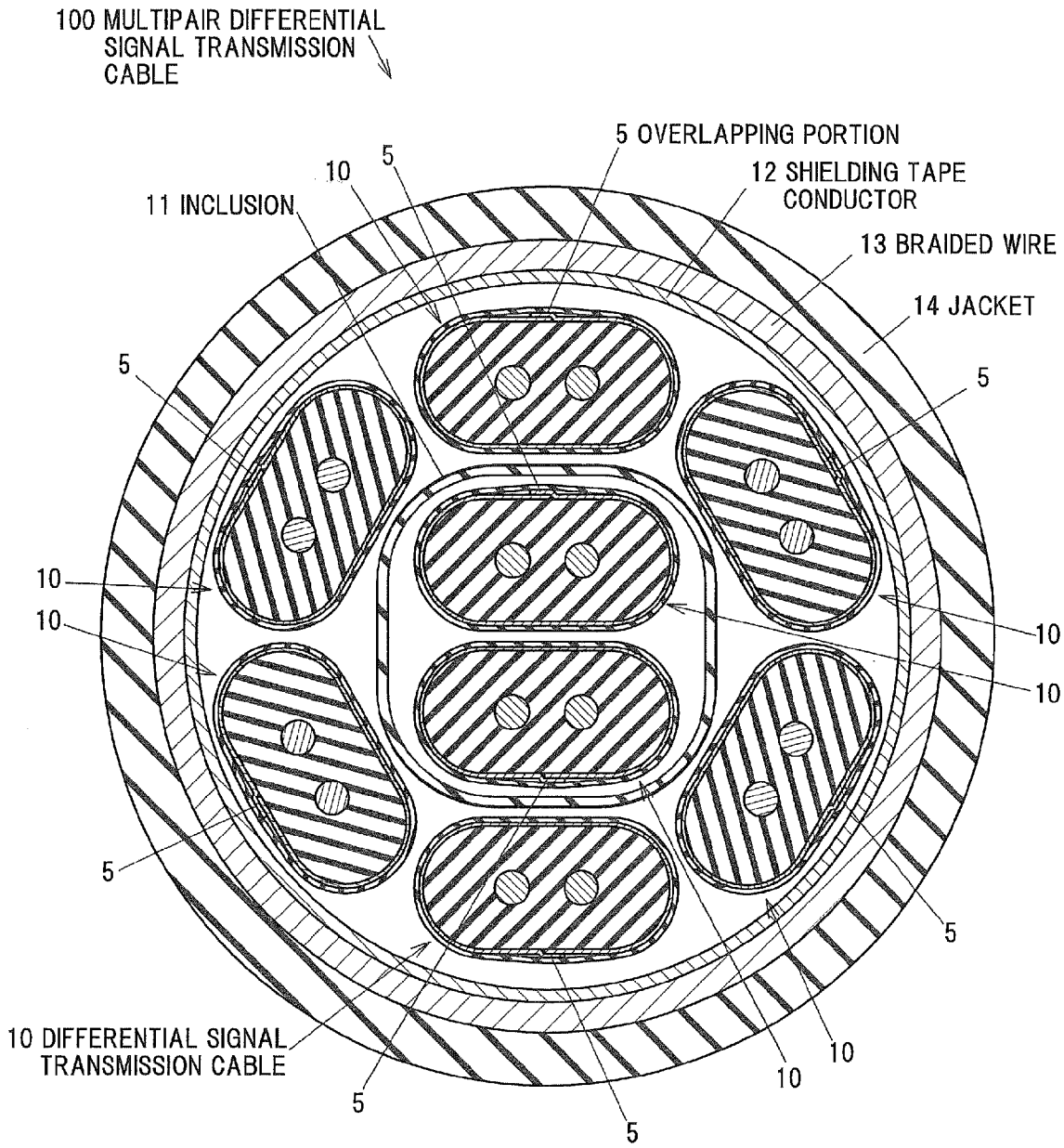
FIG. 1 is a cross sectional view showing a cross-section structure of a multipair differential signal transmission cable in a first embodiment of the present invention.
Figure 2:
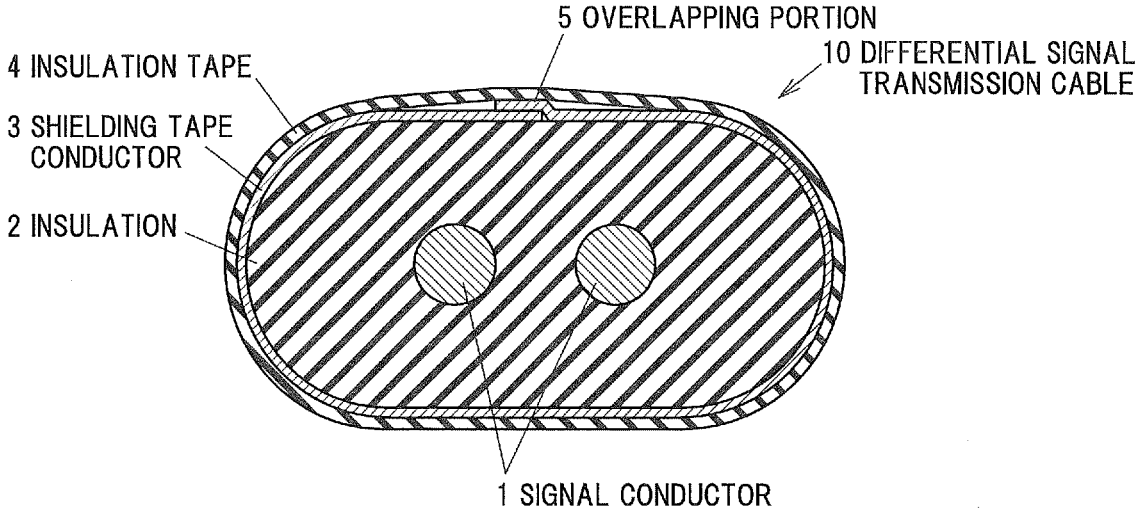
FIG. 2 is a cross sectional view showing a cross-section structure of a differential signal transmission cable used for the multipair differential signal transmission cable in the first embodiment of the invention.

FIG. 1 is a cross sectional view showing a cross-section structure of a multipair differential signal transmission cable in a first embodiment of the invention and FIG. 2 is a cross sectional view showing a cross-section structure of a differential signal transmission cable used for the multipair differential signal transmission cable in the first embodiment of the invention.

A multipair differential signal transmission cable 100 in the first embodiment is formed by bundling and twisting plural differential signal transmission cables 10 each composed of two signal conductors 1 as a differential pair, an insulation 2 covering therearound and a shielding tape conductor 3 provided on a periphery of the insulation 2. The shielding tape conductor 3 is longitudinally lapped (also referred to as cigarette roll) so as to have an overlapping portion 5 which extends in a cable longitudinal direction. The multipair differential signal transmission cable 100 further includes a shielding tape conductor 12 wrapping the plural differential signal transmission cables 10 all together, a braided wire 13 covering a periphery of the shielding tape conductor 12 and a jacket 14 covering the braided wire 13.

Eight differential signal transmission cables 10 are used in the first embodiment but the number thereof is not limited thereto. The number is preferably two, eight or twenty-four. In the first embodiment, two differential signal transmission cables 10 are arranged in the middle as viewed in a cross section and six differential signal transmission cables 10 are arranged therearound via an inclusion 11 at substantially equal intervals, as shown in FIG. 1. In case of using two differential signal transmission cables 10, it is only necessary to arrange two differential signal transmission cables 10 in the middle as viewed in a cross section. Meanwhile, in case of using twenty-four differential signal transmission cables 10, sixteen differential signal transmission cables 10 are further added to the above-mentioned eight differential signal transmission cables 10 so as to be arranged around the six differential signal transmission cables 10 via an inclusion at substantially equal intervals. Accordingly, the plural differential signal transmission cables 10 includes at least one or more pairs each composed of two adjacent differential signal transmission cables 10 in any case. Here, the two adjacent differential signal transmission cables 10 means two differential signal transmission cables 10 which are adjacent to each other without interposing an inclusion.

In the multipair differential signal transmission cable 100, the differential signal transmission cables 10 are arranged so that the overlapping portions 5 of the two adjacent differential signal transmission cables 10 do not face in a direction of each other's adjacent differential signal transmission cable 10. In FIG. 1, the differential signal transmission cables 10 are arranged so that the overlapping portions 5 of the two adjacent differential signal transmission cables 10 arranged in the middle do not face in a direction of each other's adjacent differential signal transmission cable 10. And also, the six differential signal transmission cables 10 arranged therearound are arranged so that the overlapping portions 5 of each two adjacent differential signal transmission cables 10 do not face in a direction of each other's adjacent differential signal transmission cable 10. The differential signal transmission cables 10 may be arranged such that only the overlapping portion 5 of one of the two adjacent differential signal transmission cables 10 does not face in a direction of the differential signal transmission cable 10 adjacent thereto.

In the multipair differential signal transmission cable 100, the differential signal transmission cables 10 are preferably arranged so that the overlapping portion 5 of at least one, preferably at least two, of the plural differential signal transmission cables 10 faces not toward the center but toward the outside of the multipair differential signal transmission cable 100. The differential signal transmission cables 10 arranged so that the overlapping portion 5 faces toward the outside may be one of or both of the two the differential signal transmission cables 10 arranged in the middle, or one of or two or more of the six differential signal transmission cables 10 arranged therearound. Since it is difficult to completely protect against the adverse effect caused by the overlapping portion 5 even if an inclusion is interposed, it is more preferable that the differential signal transmission cables 10 be arranged so that the overlapping portions 5 of all of the plural differential signal transmission cables 10 face toward the outside of the multipair differential signal transmission cable 100, as shown in FIG. 1.

As materials of the shielding tape conductor 12, the braided wire 13 and the jacket 14, it is possible to use materials generally used for a cable. A paper, thread or foam is used for the inclusion 11. The foam includes, e.g., foamed polyolefin such as polypropylene foam or ethylene foam.

In the differential signal transmission cable 10, the shielding tape conductor 3 is longitudinally lapped so as to have the overlapping portion 5 in a cable longitudinal direction and an insulation tape 4 covers a periphery thereof. The length (width) of the overlapping portion 5 is not specifically limited but is preferably smaller than a space between the two signal conductors 1.

It is preferable that the shielding tape conductor 3 be longitudinally lapped so that the overlapping portion 5 is located on a perpendicular line passing through substantially the middle of a line connecting the two signal conductors 1, as shown in FIGS. 1 and 2.

The differential signal transmission cable 10 preferably does not have a drain wire and the two signal conductors 1 are preferably covered all together with the insulation 2 having a shape which does not create a gap from the first shielding tape conductor. In the first embodiment, the two signal conductors 1 are covered all together with the insulation 2 having a flat oval cross-sectional shape which includes flat portions parallel to an arrangement direction of the two signal conductors 1, as shown in FIG. 2 (cross section).

Figure 3:
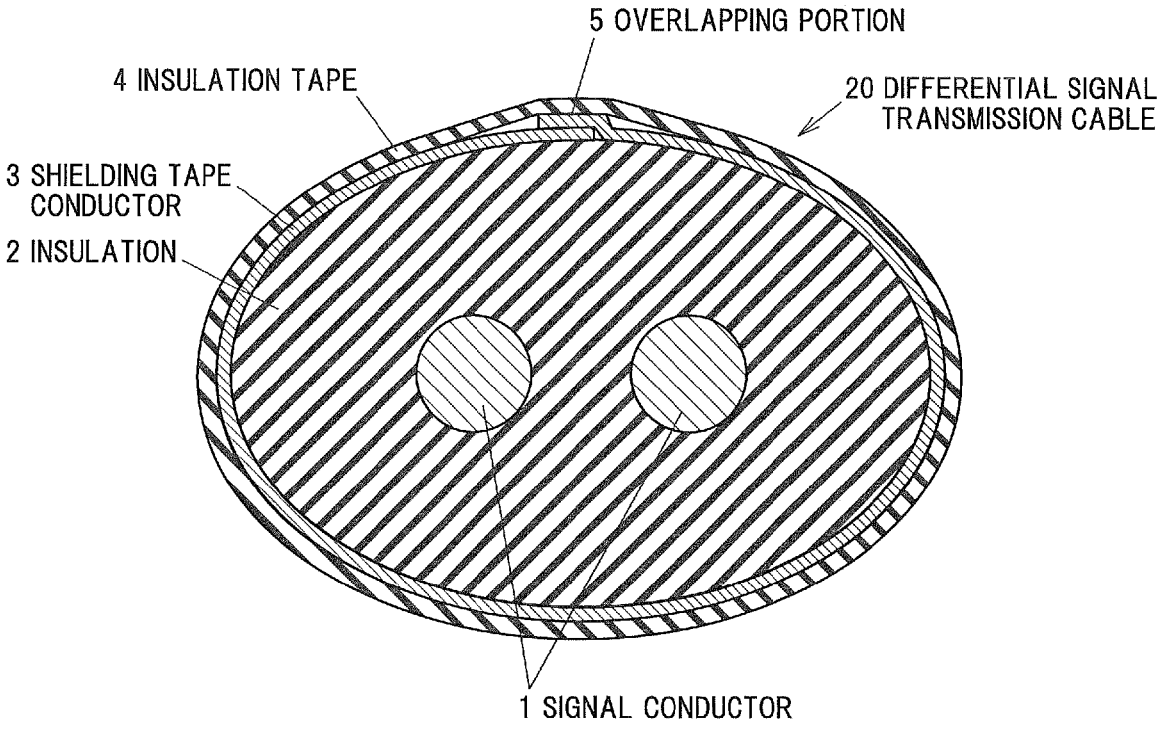
FIG. 3 is a cross sectional view showing a cross-section structure of a differential signal transmission cable in a modification of FIG. 2.

FIG. 3 is a cross sectional view showing a cross-section structure of a differential signal transmission cable in a modification of FIG. 2. The two signal conductors 1 in the present modification are covered all together with the insulation 2 having an ellipse cross-sectional shape which is long in an arrangement direction of the two signal conductors 1.

While the structure shown in FIG. 2 is advantageous in that it is easy to manufacture, the structure shown in FIG. 3 is advantageous in that a gap is less likely to be generated between the shielding tape and the insulation since an inwardly acting force (acting toward the insulation) is applied to the entire surface of the shielding tape.

As materials of the signal conductor 1, the insulation 2, the shielding tape conductor 3 and the insulation tape 4, it is possible to use materials generally used for a cable. A plated copper wire may be used as the signal conductor 1. The insulation 2 may be either a solid or a foam, and can be formed of, e.g., a Teflon-based material (Teflon is a trademark) such as tetrafluoroethylene/hexafluoropropylene copolymer or foamed polyolefin such as ethylene foam.

Use of Multipair Differential Signal Transmission Cable

The multipair differential signal transmission cable 100 in the first embodiment is suitable for large-capacity and high-speed transmission of not less than several Gbps and can be suitably used also for high-speed transmission at a level of not less than 10 Gbps. It is applicable to a cable assembly used in router, switch and server which are installed in a data center. It is also applicable to a cable assembly used in personal computer (PC) or hard disk (HDD), etc. Furthermore, it is applicable to a cable device (active cable) used for the above-mentioned use application.

Effects of the First Embodiment of the Invention

In the first embodiment, it is possible to provide a multipair differential signal transmission cable with low pair-to-pair crosstalk, and in more detail, the following effects are obtained.

(1) In order to reduce transmission of common-mode energy between pairs, it is necessary to ensure a physical distance between Agressor and Victim so as to prevent a common-mode electric field from spreading from Agressor to Victim, in addition to the shielding of each pair using a shielding tape conductor. Conventionally, there is no choice but to increase a distance between the pairs by using an insulation, etc., in order to ensure a sufficient distance therebetween, which results in a thick cable. In the first embodiment, based on a the confirmation that leakage of electromagnetic energy (caused by a common-mode current) from a surface having the overlapping portion 5 of the shielding tape conductor 3 is larger than that from an opposite surface as described later in Example, the overlapping portion 5 is arranged so as not to face a direction of the adjacent differential signal transmission cable 10. Preferably, the overlapping portion 5 is arranged in a twisted manner so as to face toward the outside of the multipair differential signal transmission cable 100. As a result, the common-mode electric field spreads toward the outside of the cable 100, and a level of electromagnetic interference to the adjacent cable 10, especially to the cable 10 located in the middle of the cable, is reduced. In addition, it is configured that the common-mode electric field spreading toward the outside of the multipair differential signal transmission cable 100 is shielded by the braided wire (frame GND) 13 located on the outer side, and the spread common-mode electric field does not interfere between adjacent multipair differential signal transmission cables 100. Therefore, it is possible to realize a multipair differential signal transmission cable without thickening a cable and without interference of the common-mode electric field from Agressor to Victim.

(2) In order to reduce a common-mode current in each pair, a common-mode component triggering a current to flow through the shielding tape conductor needs to be reduced in each differential signal transmission cable. Accordingly, it is necessary to eliminate an electrically non-equilibrium state which occurs between two signal lines as a differential pair and causes mode conversion from a differential mode into a common mode. In the first embodiment, by using the differential signal transmission cable 10 or 20 having a structure in which a drain wire and a gap prone to cause disruption of electrical equilibrium are eliminated, i.e., having the structures shown in FIGS. 2 and 3, it is possible to reduce mode conversion from a differential mode into a common mode caused by a drain wire or a gap and also to reduce the amount of the common-mode current generated thereby, and it is thus possible to reduce the common-mode electric field generated by each differential signal transmission cable. As a result, it is possible to realize a multipair differential signal transmission cable with low pair-to-pair crosstalk.

Second Embodiment of the Invention

Structure of Multipair Differential Signal Transmission

Figure 4:
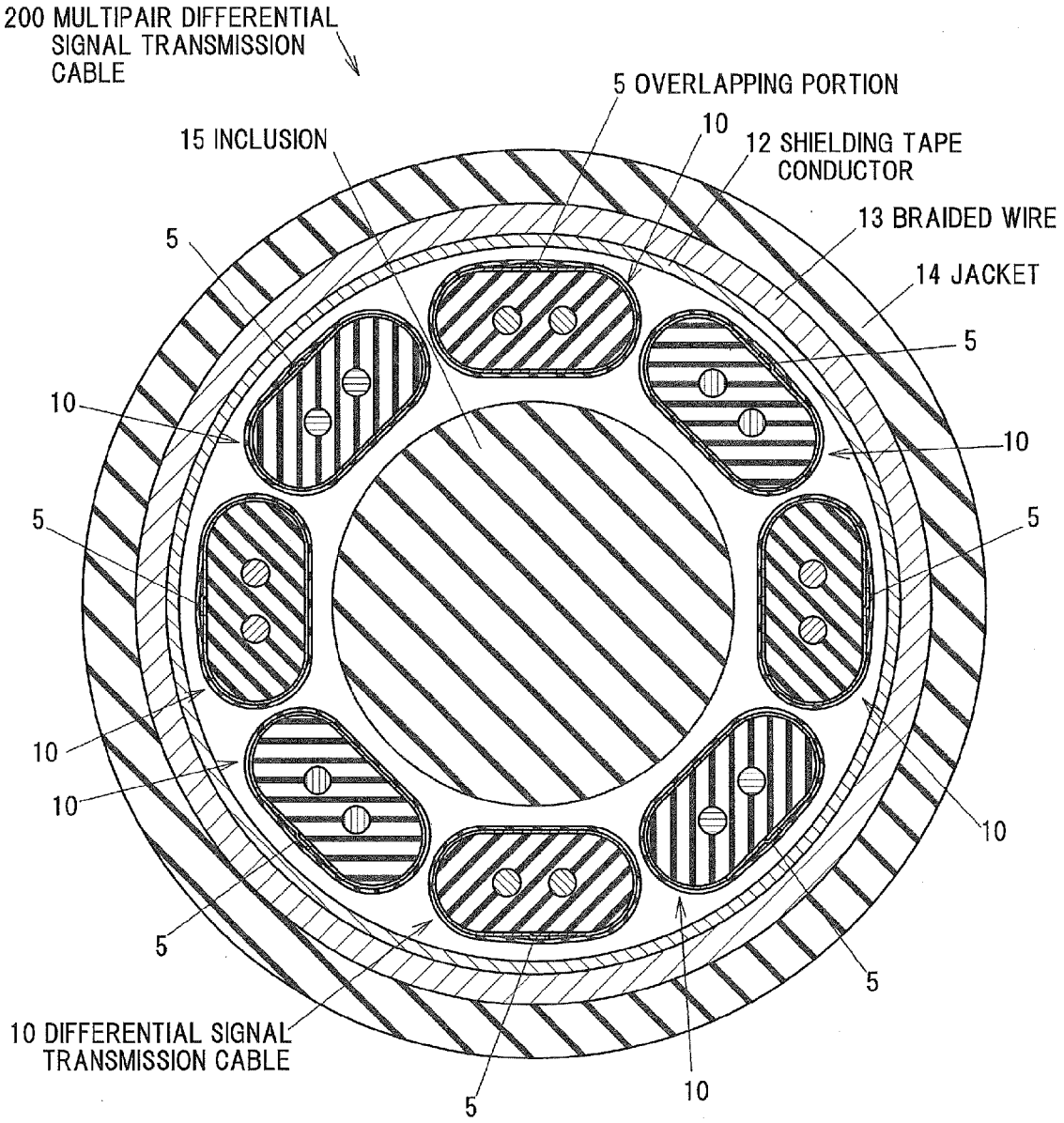
FIG. 4 is a cross sectional view showing a cross-section structure of a multipair differential signal transmission cable in a second embodiment of the invention.

FIG. 4 is a cross sectional view showing a cross-section structure of a multipair differential signal transmission cable in a second embodiment of the invention.

In a multipair differential signal transmission cable 200 in the second embodiment, an inclusion 15 is arranged in the middle of the multipair differential signal transmission cable 200 as viewed in a cross section and eight differential signal transmission cables 10 are arranged around the inclusion 15 at substantially equal intervals.

The remaining configuration is the same as the first embodiment and the explanation thereof will be omitted.

Effects of the Second Embodiment of the Invention

The second embodiment achieves the same effects as the first embodiment except a disadvantage in that a cable is thicker than that of the first embodiment.

Example

By using the following method, it was confirmed that leakage of electromagnetic energy from a surface having the overlapping portion 5 of the shielding tape conductor 3 is larger than that from an opposite surface.

Figure 5:
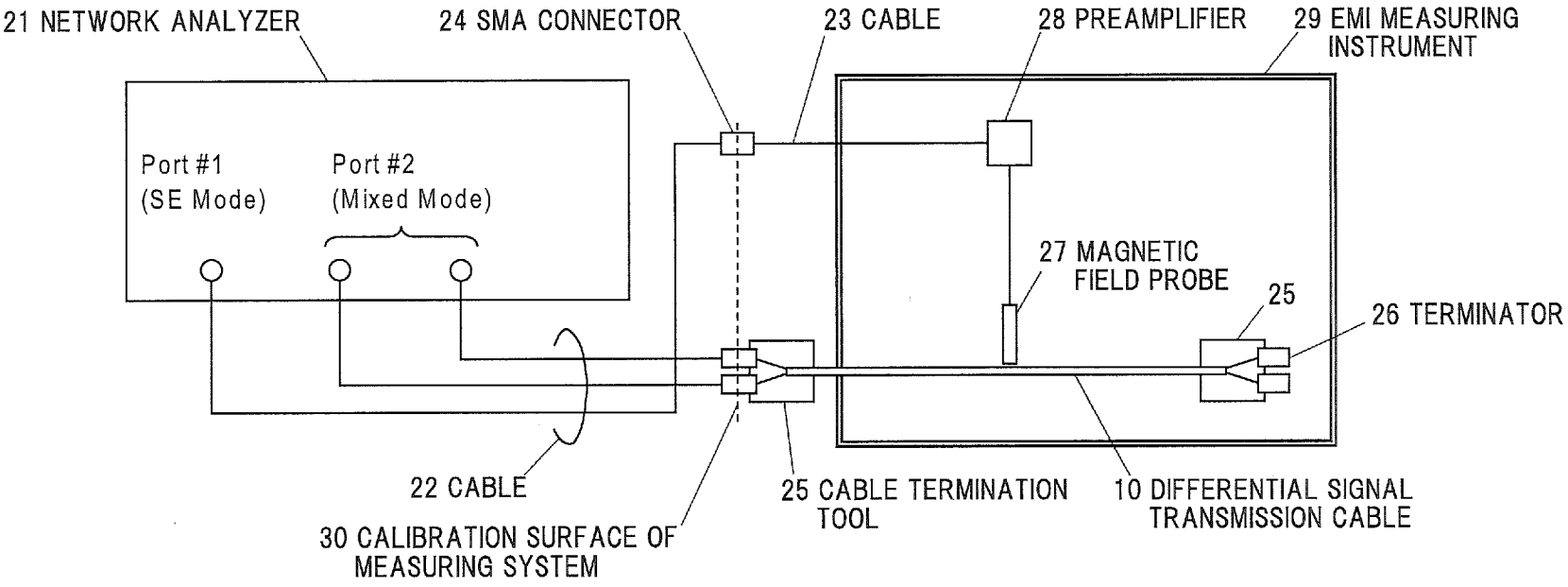
FIG. 5 is a schematic view showing an evaluation system of magnetic near-field strength in the differential signal transmission cable.

FIG. 5 is a schematic view showing an evaluation system of magnetic near-field strength in the differential signal transmission cable.

In a measuring system which is calibrated so that end portions of cables 22 connected to a network analyzer 21 are on a calibration surface 30, a signal in mixed-mode (a signal propagation mode defined by a differential mode and a common mode) is input, through a cable termination tool 25, to the differential signal transmission cable 10 as an object to be measured. At this time, in order to reduce unwanted reflected signals generated on an open end side of the differential signal transmission cable 10 as an object to be measured, anti-reflective treatment is performed on a far end side of the differential signal transmission cable 10 by the cable termination tool 25 and a terminator 26.

Since the common-mode current causing crosstalk flows a surface of the shielding tape conductor, a magnetic field probe 27 is brought close to a surface of the differential signal transmission cable 10 for detection thereof. The signal (a common-mode current component) detected by the magnetic field probe 27 is amplified by a preamplifier 28, passes through a cable 23, as SMA connector 24 and the cable 22, and is measured as a single-end mode signal at the network analyzer 21.

Figure 6:
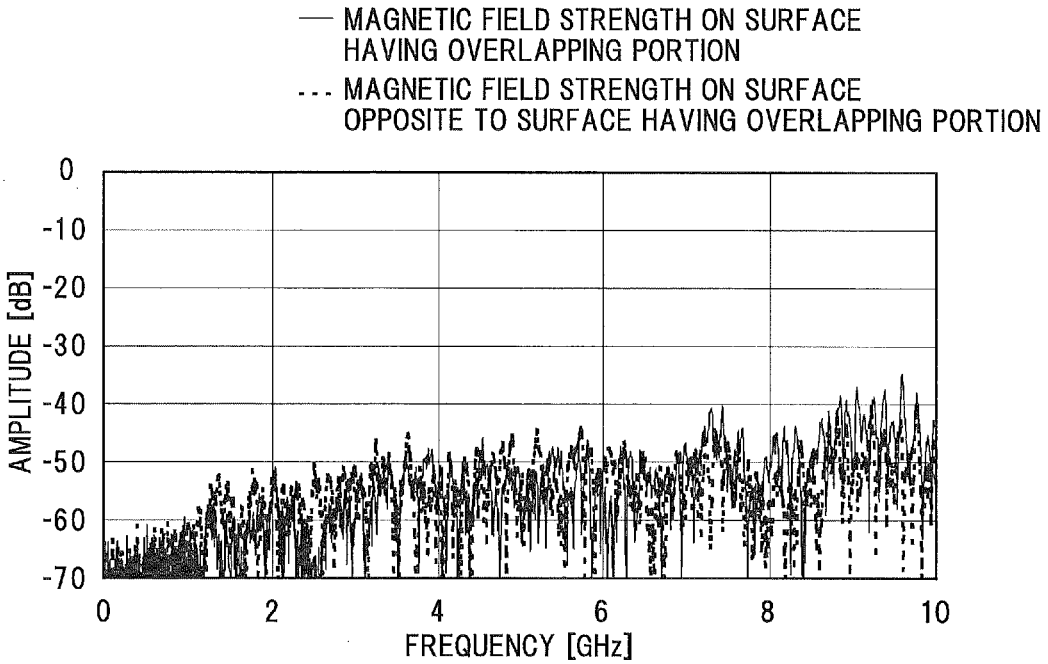
FIG. 6 is a diagram illustrating a magnetic near-field strength spectrum when a differential mode is input to the differential signal transmission cable.

FIG. 6 is a diagram illustrating a magnetic near-field strength spectrum when a differential mode is input to the differential signal transmission cable, showing a common-mode current component generated from the differential signal transmission cable 10 when a differential mode signal is input to the differential signal transmission cable 10 in the evaluation system of FIG. 5.

Figure 7:
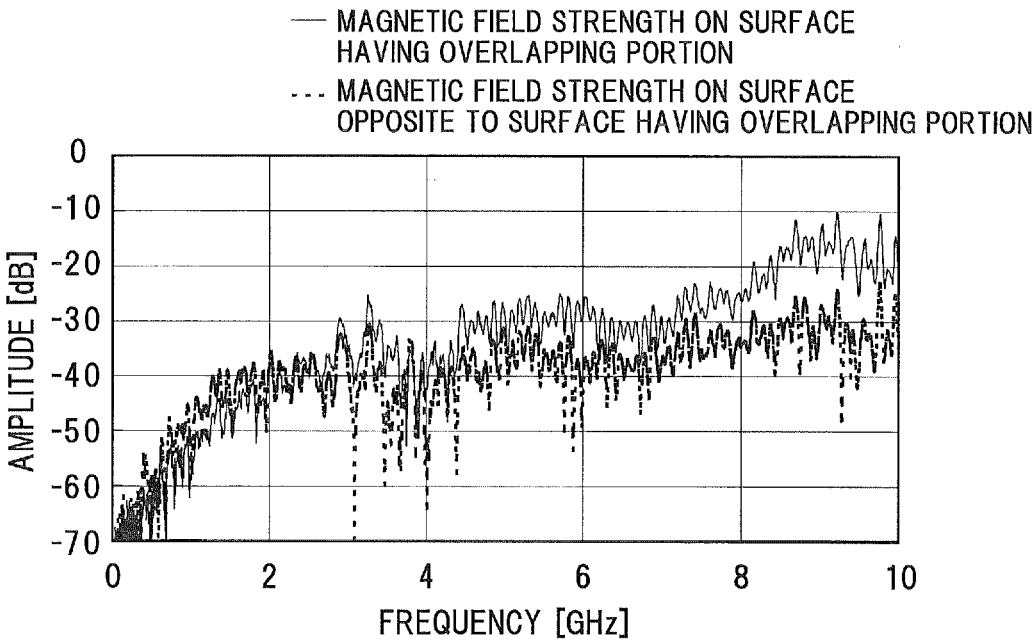
FIG. 7 is a diagram illustrating a magnetic near-field strength spectrum when a common mode is input to the differential signal transmission cable.

Meanwhile, FIG. 7 is a diagram illustrating a magnetic near-field strength spectrum when a common mode is input to the differential signal transmission cable, showing a common-mode current component generated from the differential signal transmission cable 10 when a common mode signal is input to the differential signal transmission cable 10 in the evaluation system of FIG. 5.

As shown in FIG. 6, it can be confirmed that, when a differential mode signal is input, there is no difference in the common-mode current component between the case where the magnetic field probe 27 is brought close to the surface having the overlapping portion 5 and the case where the magnetic field probe 27 is brought close to a surface opposite to the surface having the overlapping portion 5.

On the other hand, as shown in FIG. 7, it is understood that the common-mode current component on the surface having the overlapping portion 5 is larger than that on the surface opposite to the surface having the overlapping portion 5 when a common mode signal is input. That is, this shows that leakage of electromagnetic energy from the surface having the overlapping portion 5 is larger than that from the surface opposite to the surface having the overlapping portion 5 and the amount of electromagnetic energy contributing to crosstalk is different between the surface having the overlapping portion 5 and the surface opposite thereto. From FIG. 7, it is understood that this tendency is more remarkable when the frequency is higher (not less than 5 GHz, especially not less than 8 GHz), which can be considered as a meaningful difference for crosstalk design of the multipair differential signal transmission cable in the embodiment of the invention targeting signal transmission of several Gbit/s.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A multipair differential signal transmission cable, comprising:

a plurality of differential signal transmission cables being bundled and each comprising two signal conductors as a differential pair covered with an insulation and a first shielding tape conductor provided therearound, wherein the first shielding tape conductor is longitudinally lapped so as to include an overlapping portion in a cable longitudinal direction such that the overlapping portion is located on a perpendicular line passing through substantially a middle of a line connecting the two signal conductors, wherein the plurality of differential signal transmission cables comprise at least one or more pairs of two adjacent differential signal transmission cables, and wherein two of the differential signal transmission cables are arranged in a middle of the multipair differential signal transmission cable as viewed in a cross section such that the overlapping portion faces toward an outside of the multipair differential signal transmission cable;

an inclusion layer encircling the two of the differential signal transmission cables, wherein six of the differential signal transmission cables are arranged therearound via the inclusion layer such that the overlapping portion faces toward the outside of the multipair differential signal transmission cable; and an insulation tape covering a periphery of the first shielding tape conductor, wherein the multipair differential signal transmission cable is configured for high-speed transmission at a level of not less than 10 Gbps, and wherein a vacant space is provided between the insulation tape and the first shielding tape conductor.

2. The multipair differential signal transmission cable according to claim 1, wherein the differential signal transmission cables are arranged so that the overlapping portion of each of the plurality of differential signal transmission cables faces the outside of the multipair differential signal transmission cable.

3. The multipair differential signal transmission cable according to claim 1, wherein the differential signal transmission cables are arranged so that the overlapping portion of all of the plurality of adjacent differential signal transmission cables faces the outside of the multipair differential signal transmission cable.

4. The multipair differential signal transmission cable according to claim 1, wherein the differential signal transmission cable does not include a drain wire, and wherein the two signal conductors are covered all together with the insulation having a shape that does not create a gap from the first shielding tape conductor.

5. The multipair differential signal transmission cable according to claim 1, wherein the two signal conductors are covered all together with the insulation having a flat oval cross-sectional shape that comprises flat portions parallel to an arrangement direction of the two signal conductors.

6. The multipair differential signal transmission cable according to claim 1, wherein the two signal conductors are covered all together with the insulation having an ellipse cross-sectional shape that is long in an arrangement direction of the two signal conductors.

7. The multipair differential signal transmission cable according to claim 1, wherein the inclusion layer is arranged in the middle of the multipair differential signal transmission cable as viewed in a cross section, and wherein eight of the differential signal transmission cables are arranged around the inclusion layer.

8. The multipair differential signal transmission cable according to claim 1, further comprising:

a second shielding tape conductor wrapping the plurality of differential signal transmission cables all together;

a braided wire covering a periphery of the second shielding tape conductor; and a jacket covering the braided wire.

9. The multipair differential signal transmission cable according to claim 1, wherein the at least one or more pairs of two adjacent differential signal transmission cables is disposed in a circumferential direction of the multipair differential signal transmission cable, and wherein the two adjacent differential signal transmission cables are arranged such that the overlapping portion of one of the two adjacent differential signal transmission cables does not face another of the two adjacent differential signal transmission cables.

10. The multipair differential signal transmission cable according to claim 1, further comprising:

sixteen differential signal transmission cables arranged around the six differential signal transmission cables via another inclusion layer.

11. The multipair differential signal transmission cable according to claim 1, wherein a leakage of electromagnetic energy from a surface of the first shielding tape conductor that includes the overlapping portion is larger than the leakage of electromagnetic energy from a surface of the first shielding tape conductor opposite to the surface of the first shielding tape conductor that includes the overlapping portion.

12. The multipair differential signal transmission cable according to claim 11, wherein an amount of electromagnetic energy contributing to a crosstalk is different between the surface of the first shielding tape conductor that includes the overlapping portion and the surface of the first shielding tape conductor opposite to the surface of the first shielding tape conductor that includes the overlapping portion.

13. The multipair differential signal transmission cable according to claim 1, wherein the inclusion layer is disposed between the six of the differential signal transmission cables and the two of the differential signal transmission cables.

14. The multipair differential signal transmission cable according to claim 1, wherein the inclusion layer comprises a foamed polyolefin layer.

15. The multipair differential signal transmission cable according to claim 1, wherein a length of the overlapping portion is less than a distance between the two signal conductors.

16. The multipair differential signal transmission cable according to claim 15, wherein, in the overlapping portion, a bottom surface of the first shielding tape conductor extends above an upper surface of the first shielding tape conductor.

17. The multipair differential signal transmission cable according to claim 1, wherein the overlapping portion is arranged in a twisted manner in which a bottom surface of the first shielding tape conductor extends above an upper surface of the first shielding tape conductor.

18. The multipair differential signal transmission cable according to claim 1, wherein the vacant space extends from an edge of the overlapping portion to a lower surface of the insulation tape.

19. The multipair differential signal transmission cable according to claim 18, wherein the vacant space further extends from the edge of the overlapping portion to an upper surface of the first shielding tape conductor.

20. The multipair differential signal transmission cable according to claim 1, wherein a gap is provided between an inner edge of the insulation tape and an outer edge of the first shielding tape conductor.

* * * * *